33-234 SR
11/15/77 OR 4,057,905

United States Patent [19]
Piaja

[11] 4,057,905
[45] Nov. 15, 1977

[54] DEVICE FOR THE SECUREMENT OF A SIGHTING INSTRUMENT WITHIN THE BORE OF A SHOTGUN

[76] Inventor: Joseph Piaja, 470 Piaget Ave., Apt. H3, Clifton, N.J. 07011

[21] Appl. No.: 669,981

[22] Filed: Mar. 24, 1976

[51] Int. Cl.[2] ..... F41G 1/54
[52] U.S. Cl. ..... 33/234; 279/2 R
[58] Field of Search ..... 33/234, 286; 403/290, 403/297, 369, 371; 279/2 R; 294/86.25, 94, 96

[56] References Cited

U.S. PATENT DOCUMENTS

| | | | |
|---|---|---|---|
| 1,621,947 | 3/1927 | Moore | 294/86.25 X |
| 2,179,594 | 11/1939 | Johnson | 294/94 X |
| 2,773,309 | 12/1956 | Elliott | 33/234 |
| 3,744,133 | 7/1973 | Fukushima et al. | 33/234 |
| 3,908,282 | 9/1975 | Steffan | 33/234 |

*Primary Examiner*—Charles E. Phillips
*Attorney, Agent, or Firm*—Mel K. Silverman; David A. Jackson

[57] ABSTRACT

The following disclosure relates to a device for the securement of a sighting instrument within the bore of a shotgun in which the present device comprises: a main shaft; means for a spring-biased reciprocal movement which is axially secured about said shaft; a muzzle stopper having a partially cone-like contour including a circumferentially formed finger-grip therein, the stopper being axially secured about said spring-biased means such as to create a potential for hypodermic-like reciprocating movement of the stopper with respect to the main shaft; an end cone disposed at the end of the shaft opposite to that end proximate to the finger grip of the muzzle stopper; and three resilient ball-bearing rods, each having bearings at the same one end thereof, each of said rods situated about said shaft at 120° angular displacements from each other, each of said rods being secured at its non-bearing end to that portion of said stopper opposite to the finger-grip, and each of the ball-bearings normally pressing against the periphery of the end cone wherein the longitudinal position of the ball-bearings with respect to the main shaft is determined through the hypodermic-like reciprocating movement of the muzzle stopper, thereby insuring a precise fit of said stopper within the gun bore and, further, by virtue of the uniform polycentric disposition of the ball-bearings between the end cones and the inner surface of the bore, assuring an absolute concentricity of the main shaft with respect to the bore.

2 Claims, 6 Drawing Figures

DEVICE FOR THE SECUREMENT OF A SIGHTING INSTRUMENT WITHIN THE BORE OF A SHOTGUN

BACKGROUND OF THE INVENTION

The present invention relates to a means for establishing a firm and accurate platform upon which may be secured a sighting instrument, generally termed a collimater, in order to thereby enhance the accuracy of said collimater in its primary purpose of establishing a true line of sight from the telescope of the shotgun to the center of the prospective target.

Various patents in the prior art relate to collimating devices and to platform means associated therewith. An example of the state of the art in this area appears in U.S. Pat. No. 3,744,133 (1973) to Fukushima et al.

The platform securement means illustrated in said patent has, as in the case of other prior art means, been found to be less than satisfactory in its intended purpose of establishing a firm and accurate base upon which the collimater may be secured for alignment with the telescopic sight. More particularly, a special need for an improved sighting platform has been found to exist in the shotgun area.

The basic shortcoming in prior art designs has related to an absence of concentricity of the sighting platform with relationship to the bore of the gun. That is, in order to assure accuracy of the collimater, it is essential that the axis of the elongated member which will comprise the platform for the collimater be absolutely co-linear with the axis of the bore of the gun.

In light of the multitude of different diameters and contours of barrels of guns and, particularly, barrels of shotguns, it is essential that the exact center of each bore be located in order to appropriately establish the true line of sight from the telescope through the collimater to the center of the target. The present instrument is intended to do exactly this in that it serves to centralize the position of the platform of the collimater within any diameter of bore configuration throughout all generally known types of shotgun barrels.

Efforts in the prior art in attaining the above have been further encumbered by the fact that shotguns possess extremely high mirror-like finishes on the inside of their barrels. Accordingly, it is necessary, in order to attain the most beneficial function, to attain a device that will not twist, scratch or mar the mirror-like surface but which will, nonetheless, not slip, slide or otherwise move within the desired perfectly concentric placement within the bore. This problem has, in the prior art, proven to be a formidable one. Accordingly, the present invention is intended as a solution to said problem.

SUMMARY OF THE INVENTION

The present invention involves a novel clutch-like arrangement, involving the use of three precision ball-bearings, disposed 120° apart about a tapered seat and held firmly through a main spring. This arrangement has been found capable of holding a muzzle stopper which is placed within the gun bore in order to firmly align the axis of the stopper, and its associated main shaft, with the axis of the bore, thereby establishing a true bore axis for alignment of the telescopic sight.

It is an object of the present invention to provide a means for easily locating the true center of any shotgun barrel.

It is a further object of the present invention to provide a secure, accurate and functionally safe platform upon which a sight alignment instrument may be secured.

It is a yet further object of the present invention to provide a means of the above type capable of instantly and automatically locating the true center of a shotgun barrel from a muzzle depth of three or more inches, without danger of any damage to the finish of the bore.

It is a still further object of the present invention to provide a device and means of the above class which may be utilized with a shotgun having any bore or choke configuration.

It is a still further object of the invention that the present instrument be easily inserted and removed from a shotgun barrel in a retracted condition thereby eliminating all possibility of marring the inside finish of said barrel.

DETAILED DESCRIPTION OF THE INVENTION

Figure 1:
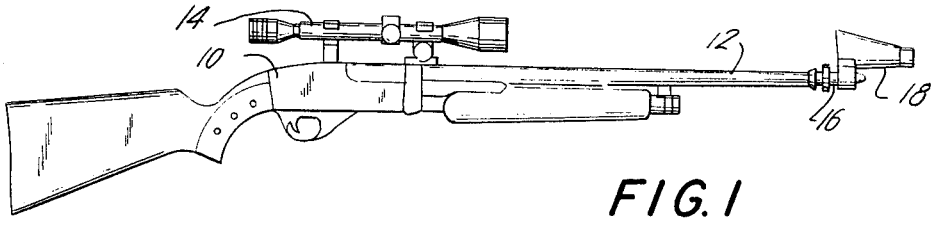
FIG. 1 is a diagrammatic view of a shotgun and telescopic sight with the main shaft of the present invention disposed within the bore.

A general understanding of the role of the present invention may be obtained with reference to FIG. 1. In said figure is illustrated a shotgun 10 having a barrel and bore 12. Mounted upon the shotgun is a telescopic sight 14. Within the bore 12 is the main shaft 16 of the hereinafter described securement means. On said shaft 16 is a sighting instrument 18, generally shown as a collimater.

Figure 2:
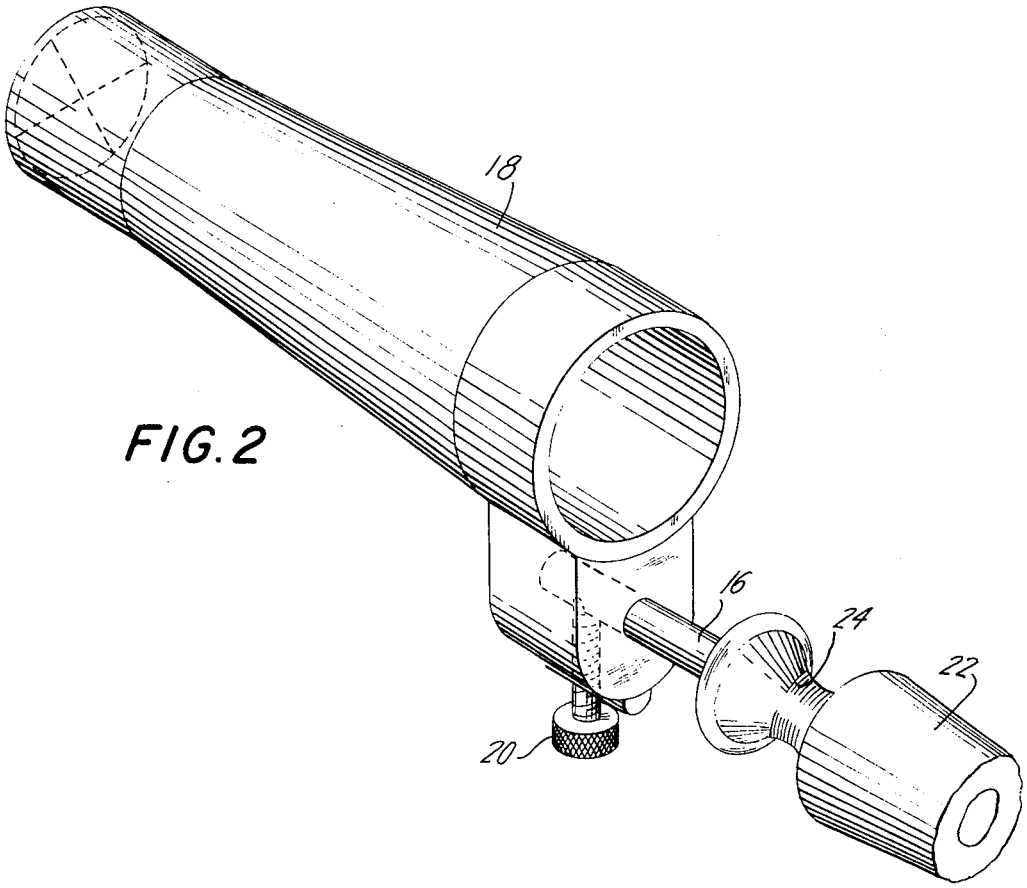
FIG. 2 is a perspective view showing the nature of the connection between the collimater and the main shaft of the present device.

With reference to FIG. 2, it is seen that the collimater 18 is typically secured to the main shaft 16 by use of a simple thumb screw 20. Also shown in FIG. 2 is a so-called muzzle stopper 22 which exhibits the contour of a truncated cone. The muzzle stopper is, as will hereinafter be specified, intended for axial securement within the bore of the barrel in order to therein attain a corresponding axial securement of the main shaft 16.

Figure 3:
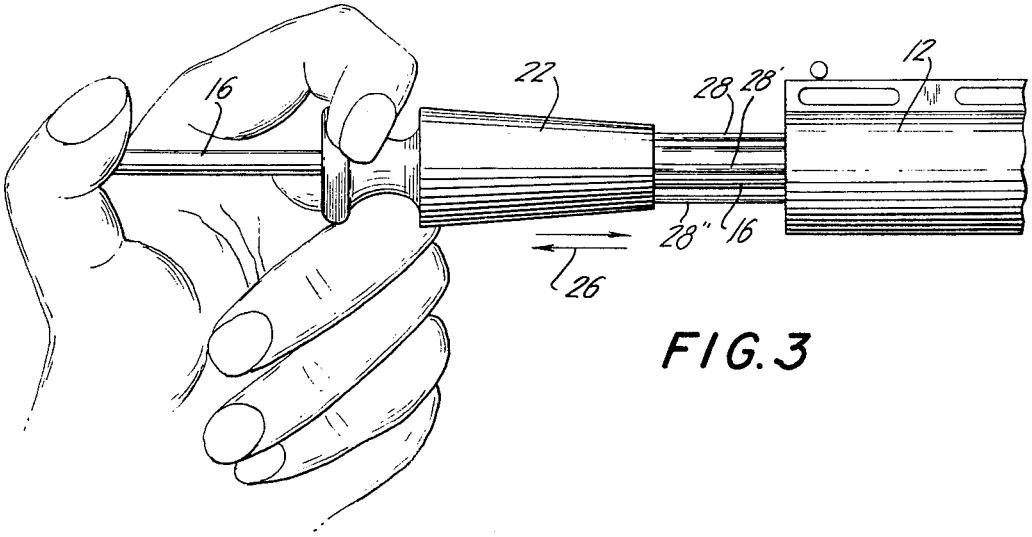
FIG. 3 is a schematic view showing a characteristic manual insertion of the present device into the bore of a shotgun.
Figure 4:
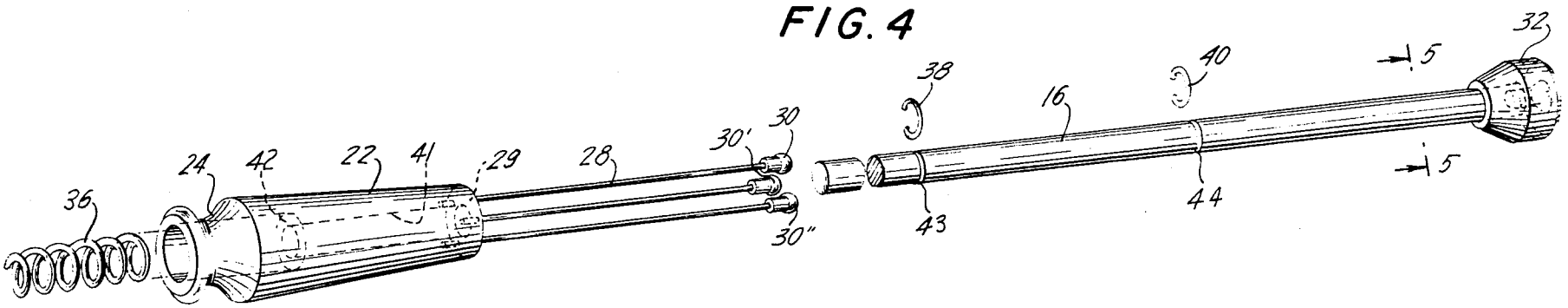
FIG. 4 is an exploded view showing the respective disposition of the various elements of the present device.

Circumferentially formed within the muzzle stopper is a finger grip 24 which, in association with the main shaft 16, enables the muzzle stopper 22 to be held by the user in the fashion shown in FIG. 3. Schematically shown in said figure is a spring-biased hypodermic-like reciprocating motion which, in particular, is illustrated by the arrows 26. Also shown in said figure are the ends of three resilient ball-bearing rods 28, 28' and 28'' which, as is more fully shown in FIG. 4, exhibit a bearing 30 at the ends thereof. It is, in said FIG. 4, to be further noted that each of said rods 28 are situated about said shaft 16 at 120° angular displacements from each other. Further, each of said rods 28 is secured at its non-bearing end 29 to that portion of said stopper 22 which is opposite to said finger grip 24.

Figure 5:
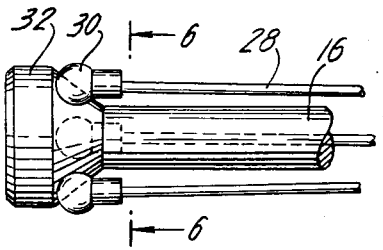
FIG. 5 is a partial breakaway view taken along line 5—5 of FIG. 4 showing, in side perspective view, the relationship between the end cone element and the three ball-bearing resilient wire elements.

Turning now to FIG. 5, it is to be noted that the three ball-bearings 30, 30' and 30'' correspond to rods 28, 28' and 28'' which, by virtue of the inner force of the radial resilience of said rods 28 (noted by arrows 34 of FIG. 6), will normally bear upon the conical periphery of an end cone 32 (see FIG. 5).

Turning again to FIG. 4, it is to be noted that the muzzle stopper 22 is provided with a primary bore 41 illustrated in phantom, which extends longitudinally through stopper 22 to enable the passage therethrough of main shaft 16. Bore 41 is increased in diameter, as it approaches the end of muzzle stopper 22 defining finger grip 24, to define counterbore 42 also shown in phantom.

During the assembly of the device of the present invention, main shaft 16 is inserted through bore 41 and counterbore 42 to protrude at both ends from stopper 22. Main shaft 16 is further adapted for reciprocation within stopper 22 by the location of spring 36 about shaft 16 at the end of stopper 22 adjacent finger grip 24. Spring 36 is adapted to abut with muzzle spring retaining ring 38 removably positioned on shaft 16 within a first annular indentation 43. Spring 36 is seated at the opposite end thereof within counterbore 42 in contact with stopper 22, and together with its abutment with ring 38, serves to retain shaft 16 in protruding position through stopper 22. Muzzle stopper 22 is held in contact with spring 36 by appropriately sized muzzle stopper retaining ring 40 positioned on shaft 16 within second annular indentation and abutting said stopper 22 at its one end 44. The above elements in combination, comprise a means for spring-biased reciprocal movement of the muzzle stopper, and its associated resilient ball-bearing rods, with respect to longitudinal position upon the main shaft 16. Thus, it is to be appreciated that through a hypodermic-like reciprocating motion schematically illustrated in FIG. 3, a strong spring-biased reciprocation of the entire combination of elements peripherally surrounding the main shaft may be obtained. The practical consequence of this feature is that the longitudinal position of the ball-bearings 30 with respect to the main shaft is self-determined so as to assure a precise fit of said muzzle stopper 22 within the gun bore 12 and, further, to assure the presence of a uniform polycentric disposition of said ball-bearings between said end cone 32 and the inner surface of the bore 12, thus assuring an absolute concentricity of said main shaft to the bore without applying pressures or impacts of a nature which might impair the high mirror-like finish which must be maintained within the bore.

Figure 6:
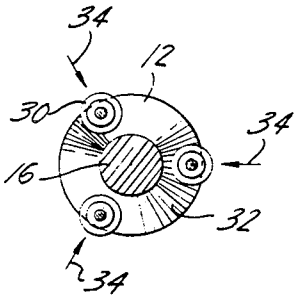
FIG. 6 is a cross-sectional schematic view taken along line 6—6 of FIG. 5.

In designing the present novel securement device, it is to be appreciated that the reciprocating spring forces, schematically illustrated as element 26 in FIG. 3, must relate to the radial resilient forces, shown as elements 34 in FIG. 6, in such a manner so as to enable the amount of force which may be comfortably exerted by the thumb of the user to permit an ease of reciprocation of the muzzle stopper 22 as well as an incremental radial displacement of the ball bearings 30 which, in applied usage, will correspond to the difference in radius between the smallest and largest radius of bore configurations which may be encountered in present day shotguns. It has been found that these design considerations can be conformed with through the usage of generally available stainless steel springs and wires.

It may be appreciated that the above noted ease of reciprocation of the muzzle stopper and its associated elements enables the present device to be inserted into and removed from a shotgun barrel in a retracted position through the simple expedient of applying pressure by three fingers as shown in FIG. 3. That is, unlike prior art devices of the present class, the invention need not be forced into or out of the bore, nor are adjustments relative to bore size required. In other words, following the insertion of the present device into the bore as far as the stopper 22 will permit, the outer end of the shaft 16 is released by the thumb of the user. At this point, the forces 26 and 34 will interact in order to establish a longitudinal and radial position of the ball-bearings 30 against the bore 12 which position will secure the main shaft 16 upon the exact longitudinal axis of the bore.

The virtually infinitesimal surface area of bearing contact against the bore effectively eliminates the possibility of injury to the bore.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

What is claimed is:

1. In combination, a sighting instrument and a device for the securement of said sighting instrument in the bore of a shotgun, said combination including:

a. a muzzle stopper having a truncated, cone-like contour including a circumferentially formed fingergrip therein, said stopper provided with an axially extending cylindrical bore, said bore comprising a first main bore, and a second larger diameter counterbore, b. a main shaft extending through said cylindrical bore and adapted for spring-biased reciprocal movement therewithin, c. a spring annularly surrounding said main shaft and in contact with said counterbore for facilitating said spring-biased reciprocal movement;

d. an end core disposed at the end of said shaft located furthest away from said finger-grip of said muzzle stopper; and e. three resilient ball-bearing rods each having a ball-bearing at the same one end thereof, each of said rods situated about said shaft at a 120° angular displacement from each other, each of rods being secured at its non-bearing end to that portion of said stopper opposite to said finger-grip, each of said ball-bearings normally pressing against the periphery of said end cone, wherein the longitudinal position of said ball-bearings with respect to said shaft is self-established through said reciprocating movement of said muzzle stopper, thereby attaining a precise fit of said muzzle stopper within the gun bore and an absolute concentricity of said main shaft with respect to the bore, wherein said sighting device is mounted on the end of said main shaft opposite said end cone.

2. The device as recited in claim 1 further including a spring retaining ring secured about said main shaft abutting said spring at the opposite end thereof, and a stopper retaining ring secured about said shaft abutting said muzzle stopper at the end thereof opposite from said counterbore, whereby said retaining rings restrict the movement of said main shaft with respect to said muzzle stopper.

* * * * *